US006269494B1

(12) United States Patent
Moretto

(10) Patent No.: US 6,269,494 B1
(45) Date of Patent: Aug. 7, 2001

(54) SYSTEM FOR THE FIXATION OF SIDE PANELS ON A BATHTUB SUPPORT STRUCTURE AND THE LIKE

(75) Inventor: Alessandro Moretto, Castions Di Zoppola PN (IT)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/400,752

(22) Filed: Sep. 22, 1999

(30) Foreign Application Priority Data

Sep. 23, 1998 (IT) ..... RE980048 U

(51) Int. Cl.[7] ..... A47K 3/16
(52) U.S. Cl. ..... 4/584
(58) Field of Search ..... 4/584, 592, 593; 52/34, 35

(56) References Cited

U.S. PATENT DOCUMENTS 3,964,229 * 6/1976 Fischer ..... 52/698
5,477,568 * 12/1995 Wang ..... 4/592
5,788,198 * 8/1998 Sharpe ..... 248/210

FOREIGN PATENT DOCUMENTS

2911822 * 10/1980 (DE) ..... 4/592
0450347 * 10/1991 (EP) ..... 4/592

* cited by examiner

*Primary Examiner*—Charles E. Phillips

(57) ABSTRACT

In a preferred embodiment, the system includes a plurality of anchoring plates (50), each with a series of holes (52) positioned on the anterior face of the plate and at right angles to it, close together, capable of accommodating a fastening screw (53) inserted in a respective through-hole (31) provided in the facing panel, and adjustable attachment assemblies each capable of fixing such a respective plate to the support structure, in such a way that the anterior face thereof is turned toward the inner face of the facing panel.

21 Claims, 3 Drawing Sheets

SYSTEM FOR THE FIXATION OF SIDE PANELS ON A BATHTUB SUPPORT STRUCTURE AND THE LIKE

BACKGROUND OF THE INVENTION

The present invention relates generally to bathtubs and similar equipment, such as hydromassage (whirlpool) tubs, tubs for thermal treatments, etc. More specifically, the invention concerns the installation of accessory elements on such tubs, typically finishing panels.

As is known, one of the techniques that are largely being employed currently for the installation of similar tubs provides for the use of a parallelepipedal metal structure of horizontal design, the lower part of which is equipped with adjustable support feet resting on the floor and the upper part of which is provided with an opening in which the basin of the tub is accommodated.

The perimeter shelf enveloping the mouth of the cavity of the tub is supported against an upper peripheral frame of the structure in such a way that the perimeter edge of the shelf, which is turned down, covers the frame.

Moreover, to mask the support structure, finishing panels are used that are bound to the structure in the following manner:

- the upper edge of every single panel is inserted from below behind the respective portion of the descending turned-down lip of the tub;
- the upper part of the support structure which faces the panel is provided with thrust organs which are prepositioned to maintain the said upper edge of the panel elastically loaded toward and against the said portion of the descending turned-down lip; and
- joined to the lower part of the support structure are metallic bodies, or permanent magnets, which correspond, on the facing part of the panel, with respective permanent magnets, or metallic bodies.

The widespread use of the fastening technique described above has revealed that it is unsatisfactory in terms of the safety of use of tubs thus equipped.

A first disadvantage common to all types of tubs, whether or not equipped with pumping units or other electrically operated devices, is due to the fact that the connection of the panels effected by said magnetic type means is stable and safe with regard to thrusts directed toward the tub, but offers little resistance with regard to forces in the opposite direction. It can substantially happen, as, in fact, it has been found in practice, that the panels detach themselves relatively easily from their own support structure, which can involve seriously dangerous situations, in particular if there is a child, or an elderly or disabled person in the vicinity.

Another drawback typical of those tubs that are equipped with electrically operated devices is that the common restraining means of a mechanical nature which provide for the use of screws result in many electrically conductive bridges across which the electric current can reach the external face of the panels in the event of breakdown or malfunction, for example the presence of an exposed electric cable.

The objective of the present invention is to remedy the above drawbacks within the context of a simple and rational constructive solution.

The objective is achieved owing to a system of fixation having the features described and claimed herein.

SUMMARY OF THE INVENTION

The system of the present invention comprises a plurality of anchoring plates, each having a series of holes placed on the anterior face of the plate and at right angles to it, close together, capable of accommodating a fastening screw inserted in a respective through-hole provided in the facing panel, and adjustable attachment assemblies each capable of fixing such a respective plate to the support structure, in such a way that the anterior face thereof is turned toward the inner face of the facing panel.

In a particular embodiment, the system of the present invention provides the customary elastic thrust organs or members capable of acting against the inside face of the upper edge of the panels connected to the support structure of a tub in combination with the said anchoring plates which are prepositioned to bind the said panels to the base of the said support structure.

In a particular embodiment, the said holes of the said plates are blind holes.

Owing to the above-mentioned means, all the objectives of the invention are achieved:

- first, by the fact that the panels are bound in a bilateral and safe manner to the support structure of the tube, and
- second, because the creation of any electric bridge whatsoever for passage of current outside the panels is avoided.

BRIEF DESCRIPTION OF THE DRAWINGS

To better understand the constructive characteristics and merits of the invention, reference is made hereafter to the figures of the appended drawings in which.

DETAILED DESCRIPTION OF THE DRAWINGS

Figure 1:
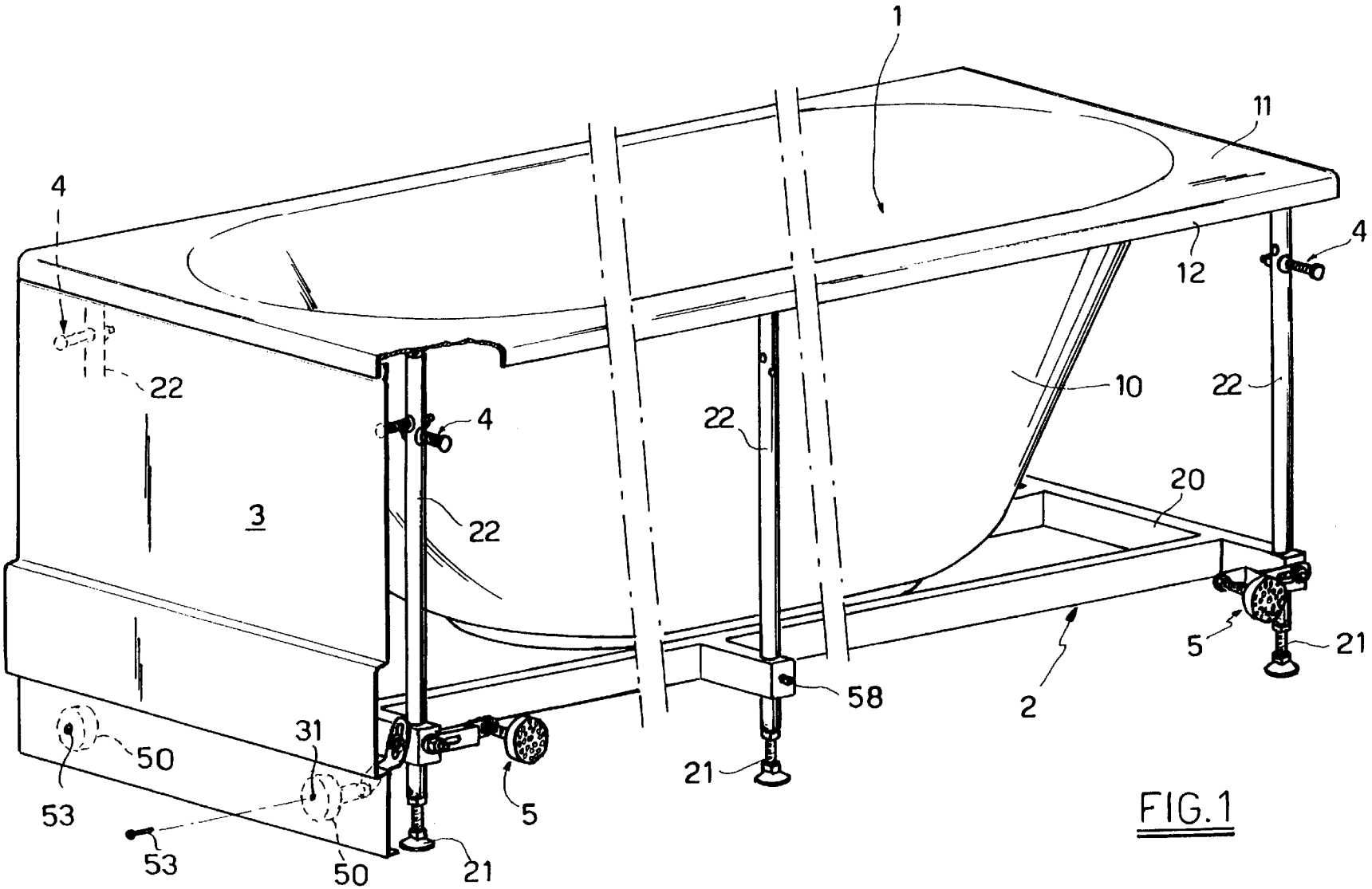
FIG. 1 is a cutaway split perspective view which shows a common bathtub equipped with a system in accordance with the present invention.

FIG. 1 shows in summary a bathtub 1, a support structure 2 for the bathtub 1, and one of the masking panels 3 of the said structure 2.

The tub 1 shown in FIG. 1 is an ordinary bathtub, although it is possible to adopt the means according to the present invention for other types of tubs, for example hydromassage (whirlpool) tubs.

Figure 3:
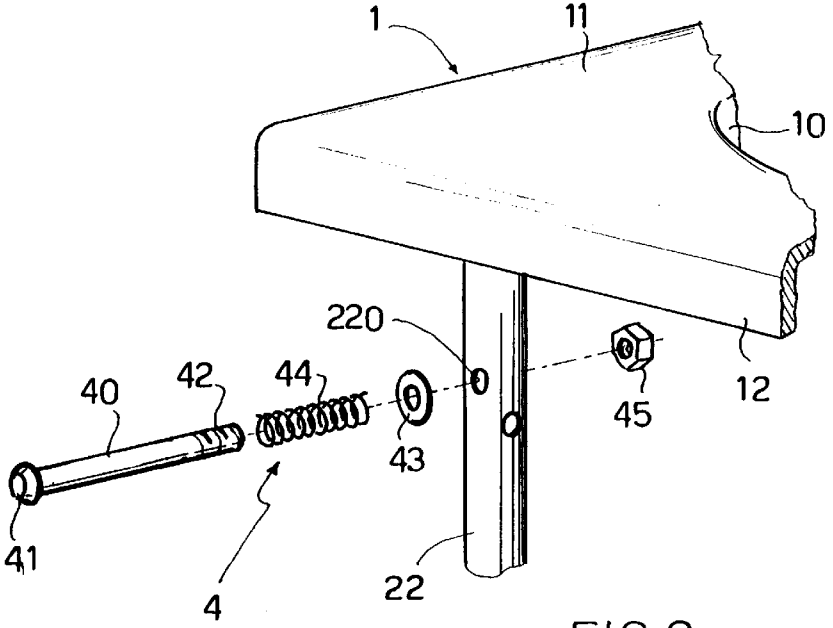
FIG. 3 is an exploded perspective view of the thrust organ or member shown in FIG. 2.
Figure 2:
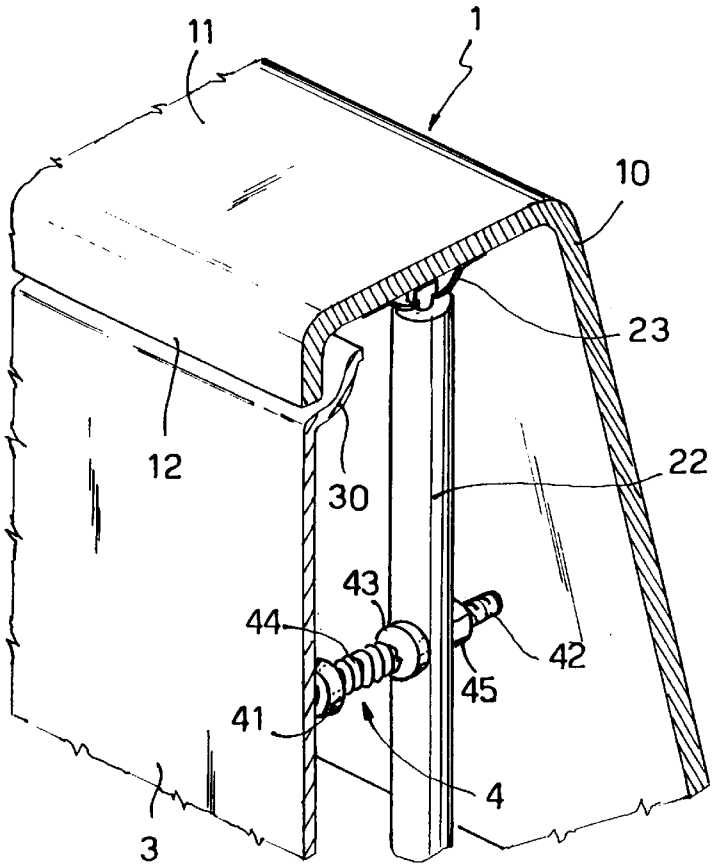
FIG. 2 is a sectional perspective view which shows one of the thrust organs or members associated with the upper edges of the masking panels of the support structure of the tub.

As is customary, tub 1 includes a basin 10, a flat perimeter shelf 11, and a margin edge 12 which is turned down (see FIGS. 1 to 3).

Support structure 2 of the tub 1 includes a base frame 20 which is peripherally provided with a series of posts 22 which are equipped at the bottom with adjustable feet 21 resting on the floor while supporting a molding 23 at the top (see FIG. 2) against which the said shelf 11 rests.

As illustrated in FIGS. 1 and 2, the upper edge 30 of each single panel 3 is folded back, first toward its own inside face, namely toward structure 2, and secondly upwards, so as to make available a seat for use by the said edge 12 turned down.

The following are provided for fixation of the panels 3 to the structure 2: an upper series of elastic thrust organs or members 4 and a lower series of adjustable attachment assemblies 5.

Specifically, each thrust organ or members 4 (see FIGS. 2 and 3) includes:

a cylindrical rod 40 which is smoothly accommodated inside a transverse through-hole 220 drilled in the respective post 22 and which has, at one end, an enlarged head 41 and, at the opposite end, a threaded piece 42;

an opposing washer 43 that is threaded on the said rod 40 and abuts against the rod 22;

a compression spring 44 that is threaded on the said rod 40 and lies between the said head 41 and the said washer 43, as well as an anti-unthreading nut 45 that is tapped on the said threaded piece 42 and is on the side of the post 22 which is set against that occupied by the washer 43.

These organs or members 4, in themselves known, have the function of constantly maintaining the upper edge 30 of the panels 3 elastically thrusting toward and against the descending turned-down edge 12 of the tub 1.

Figure 4:
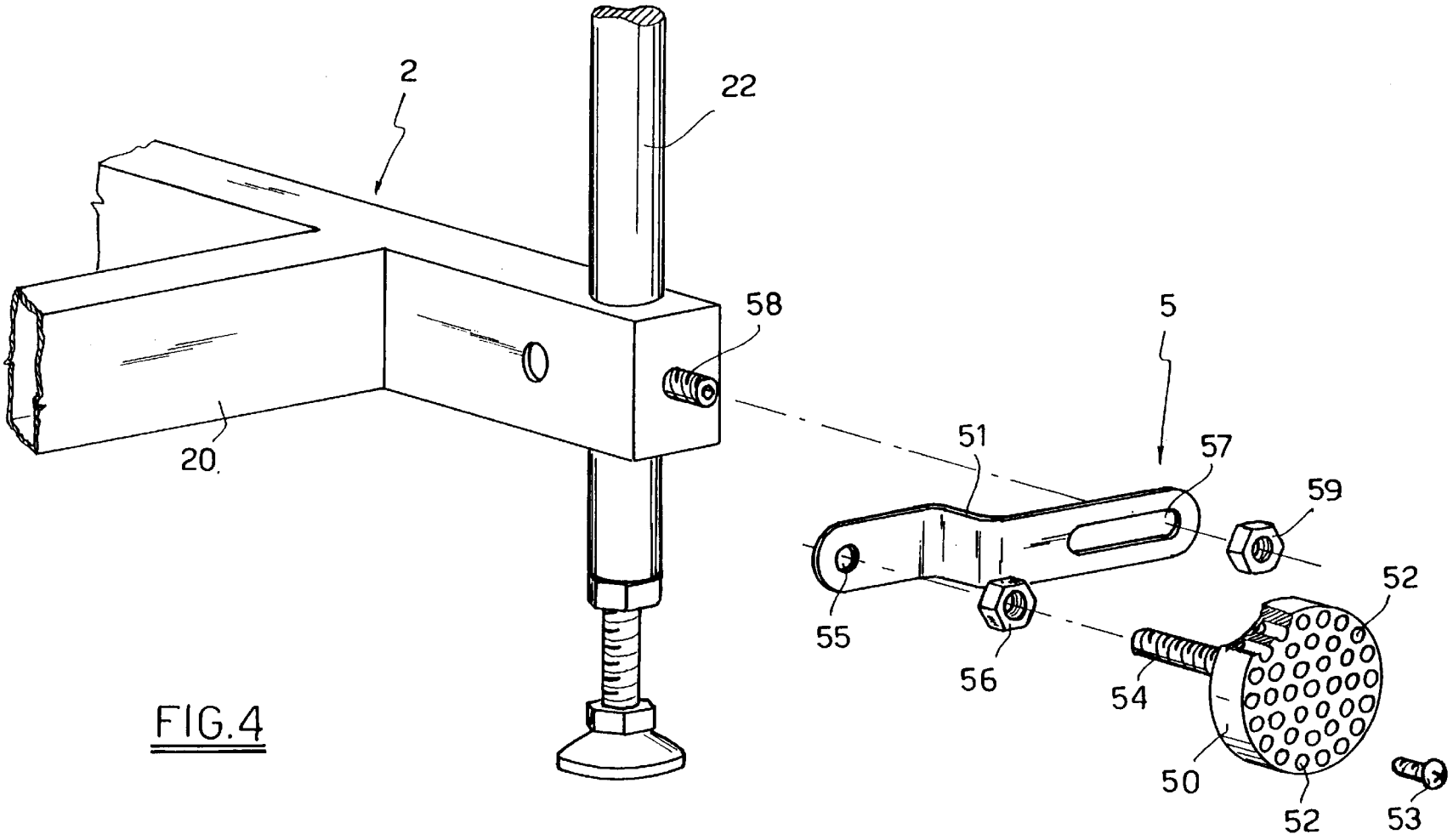
FIG. 4 is an exploded perspective view of one of the attachment assemblies associated with the lower edges of the said masking panels.

In accordance with the present invention—see FIGS. 1 and 4 in particular—every single attachment assembly 5 includes a plate 50 in the form of a disk facing the inside face of the respective panel 3 and a flat, elongated bracket 51 located behind it which is bent back in a step.

The plate 50 is made of a material of poor electrical conductivity, for example a relatively rigid synthetic resin.

This plate has a plurality of closely spaced, identical orthogonal blind holes 52 which are distributed according to concentric circumferential series, with the holes of one series being intercalated with those of the respective internal and external adjacent series thereto in order to minimize the spacing among the said holes 52.

Associated with the latter is a self-tapping screw 53 which matches up, on panel 3, with a respective through-hole 31 (see FIG. 1).

In the process of assembling the panels 3, blocking the panels against the plates 50 presents no problem whatsoever because the relevant number of blind holes 52, in addition to being very close to one another, permits the almost automatic centering of the self-tapping screws 53 with one of the holes 52, even when the bracket 51 is not precisely oriented in relation to hole 31 due to error or the presence of obstructing elements behind it.

The same plate 50 is equipped in back with a coaxial threaded tang 54 which is tapped in a threaded through-hole 55 drilled at one end of the bracket, and associated with the said tang 54 is a lock nut 56.

On the other hand, hole 55 can be internally smooth, in which case a nut and check-nut assembly will be required for the adjustment and blocking of the tang 54.

Finally, at the opposite end of the bracket 51, an adjustment eyelet 57 is provided which is passed onto a grub screw 58 threaded on structure 2, and blocked there by means of the nut shown as 59.

The merits and advantages of the invention, as well as its embodiments in use, are clearly understandable from the above and an examination of the appended figures.

What is claimed is:

1. A system for fixating one or more side panels to a bathtub support structure, said system comprising:

a plurality of anchoring plates, each plate having an anterior face provided with a plurality of closely spaced holes;

a plurality of adjustable attachment assemblies for adjustably attaching each of said anchoring plates to the bathtub support structure; and a plurality of fasteners for securing the side panel to said anterior face of said anchoring plate, wherein each of said holes is adapted to receive one of said fasteners, and wherein each of said anchoring plates further comprises a tang disposed on a posterior face opposite said anterior face, and wherein said adjustable attachment assembly comprises a bracket with a through-hole adapted to receive said tang.

2. The system according to claim 1 wherein said anchoring plates are made of an electrically insulative material.

3. The system according to claim 1 wherein said fasteners are self-tapping screws.

4. The system according to claim 1 wherein said closely spaced holes are blind holes.

5. The system according to claim 1 wherein said closely spaced holes are through-holes.

6. The system according to claim 1 wherein the position of said anchoring plate is adjustable in a plane perpendicular to the plane of the panel.

7. The system according to claim 1 wherein the position of said anchoring plate is adjustable in a plane parallel to the plane of the panel.

8. The system according to claim 1 wherein said tang is provided with an eyelet.

9. The system according to claim 8 wherein the support structure has a plurality of projections capable of passing through said eyelet.

10. The system according to claim 1 further comprising at least one thrust member attached to the support structure for contacting the panel.

11. A bathtub support structure for supporting a bathtub basin and at least one side panel, said structure comprising:

a frame adapted to hold said bathtub basin;

a plurality of adjustable attachment assemblies mounted on said frame;

a plurality of anchoring plates, each said plate mounted on a respective said adjustable attachment assembly, each plate having an anterior face provided with a plurality of closely spaced holes; and a plurality of fasteners for securing the side panel to said anterior face of said anchoring plate, wherein each of said holes is adapted to receive one of said fasteners.

12. The structure according to claim 11 wherein each of said adjustable attachment assemblies comprises a bracket capable of being adjusted translationally with respect to said frame.

13. The structure according to claim 11 wherein each of said adjustable attachment assemblies comprises a bracket capable of being adjusted rotationally with respect to said frame.

14. The structure according to claim 11 wherein said anchoring plates are made of an electrically insulative material.

15. The structure according to claim 11 further comprising a plurality of thrust members attached to said support structure for contacting the panel.

16. The structure according to claim 11 wherein each of said anchoring plates further comprises a tang disposed on a posterior face opposite said anterior face, and wherein said adjustable attachment assembly comprises a bracket with a through-hole adapted to receive said tang.

17. The structure according to claim 16 wherein said tang is adjustably positioned on said bracket.

18. The structure according to claim 16 wherein said tang is threaded.

19. The structure according to claim 18 wherein said through-hole in said bracket is threaded.

20. The structure according to claim 16 wherein said tang is provided with an eyelet.

21. A system for fixating one or more side panels to a bathtub support structure, said system comprising:

a plurality of anchoring plates, each plate having an anterior face provided with a plurality of closely spaced holes;

a plurality of adjustable attachment assemblies for adjustably attaching each of said anchoring plates to the bathtub support structure;

a plurality of fasteners for securing the side panel to said anterior face of said anchoring plate, wherein each of said holes is adapted to receive one of said fasteners; and at least one thrust member capable of attachment to the support structure for biasing the panel outward.

* * * * *